United States Patent [19]

Ely

[11] 4,027,168

[45] May 31, 1977

[54] RAPID SHUTTER MECHANISM

[75] Inventor: Richard E. Ely, Huntsville, Ala.

[73] Assignee: The United States of America as represented by the Secretary of the Army, Washington, D.C.

[22] Filed: Sept. 9, 1975

[21] Appl. No.: 611,771

[52] U.S. Cl. ..... 250/514

[51] Int. Cl.[2] ..... G21F 5/04

[58] Field of Search ..... 250/511, 512, 513, 514

[56] References Cited

UNITED STATES PATENTS

| | | | |
|---|---|---|---|
| 3,346,737 | 10/1967 | Neuhaus | 250/511 |
| 3,487,218 | 12/1969 | Krebs et al. | 250/511 |

*Primary Examiner*—Alfred E. Smith
*Assistant Examiner*—B. C. Anderson
*Attorney, Agent, or Firm*—Nathan Edelberg; Robert P. Gibson; James T. Deaton

[57] ABSTRACT

An electromagnetic beam propagator includes a shutter device having a member with an aperture for passage therethrough of a high energy beam. A pair of plates are slidably disposed on the member and oppositely secured to respective pistons with a link secured therebetween to restrain the plates in overlapped relation while a control applies an initial pressure to the pistons to retain the plates in position covering the aperture.

The control increases the piston pressure to apply to the link a stress approaching the yield strength thereof as the energy of the beam arrives at normal value and subsequently further increases the piston pressure for rupture of the link and rapid operation of the pistons to provide substantially step function exit of the beam from the propagator and to avoid disintegration of the plates by accumulated energy of the beam.

2 Claims, 1 Drawing Figure

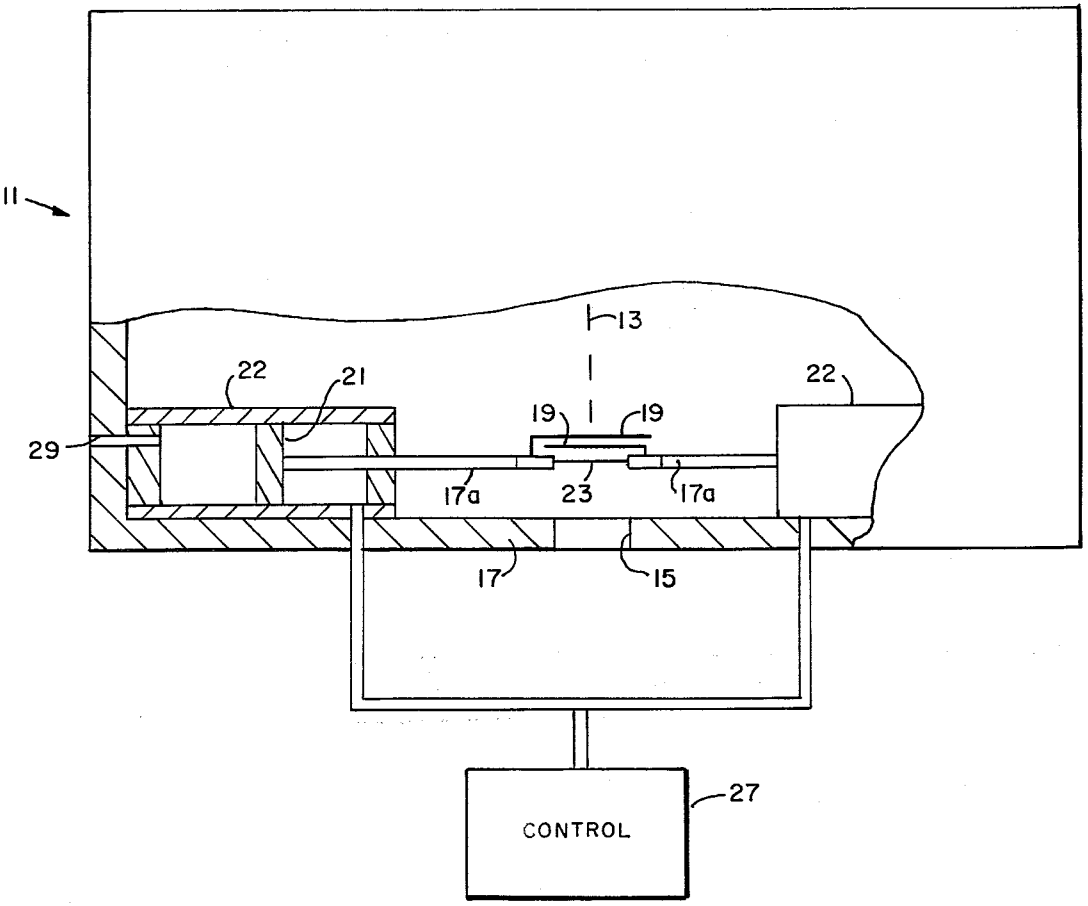
11
13
22
19
19
17a
17a
23
21
22
29
15
17
27
CONTROL

RAPID SHUTTER MECHANISM

DEDICATORY CLAUSE

The invention described herein may be manufactured, used, and licensed by or for the Government for governmental purposes without the payment to me of any royalties thereon.

BACKGROUND OF THE INVENTION

Prior art shutter mechanisms usually employed springs, fluid under compression or electromagnetic devices to uncover relatively small openings such as camera apertures for light transmission. The shutter mechanism described herein covers a relatively large opening for transmission of the high energy beam and the commensurately large cover plates are required to operate from fully closed to fully open position within a millisecond after the beam arrives at normal energy value to provide the step function operation.

BRIEF DESCRIPTION OF THE DRAWING

The single FIGURE of the drawing is a diagrammatic view partially in section of a rapid shutter mechanism according to this invention.

DESCRIPTION OF THE PREFERRED EMBODIMENT

A propagator 11 developes an electromagnetic beam 13 of 100+ KW energy level that requires an exit aperture 15 of substantially 8 square inches (2 inches × 4 inches) in a member 17. Each of a pair of plates 19 (each 6 inches × 10 inches × ⅛ inch) is slidably disposed on member 17 and respectively secured by piston rod couplings 17A to a pair of opposed 5 inch diameter pistons 21 in cylinders 22 secured to member 17. A link 23 is secured to piston rod couplings 17A and between pistons 21 to retain the plates in fully closed overlapped relation.

A control 27 includes a source of gas pressure in parallel communication with pistons 21 for application thereto of an initial pressure to retain the plates in the closed position covering aperture 15.

In operation, the piston pressure is increased for application to the link of a load resulting in a link stress just below the elastic limit thereof as the beam achieves the normal energy value and subsequently the pressure is further increased to apply a stress beyond the ultimate strength of the link for rupture thereof and rapid operation of the plates (less than a millisecond) from the fully closed position thereof to full opening of aperture 15.

An orifice 29 is provided for escape of the air behind pistons 21 for dash pot operation to dampen rebound of plates 19.

I claim:

1. A propagator of electromagnetic beams including a member with an aperture for traverse of an electromagnetic beam therethrough comprises:

a shutter mechanism including a pair of plates slidably disposed on said member and being in an overlapped relation for closing said aperture, a pair of cylinders disposed thereon and provided with pistons oppositely secured to said plates for actuating said plates apart to an open position, a rupture link secured between said pistons to retain said plates in overlapped relation, and, a control with a source in parallel communication to apply successive pressures to said pistons, to retain the plates in closed position, to apply stress to said link limited by the yield strength thereof as the beam achieves normal energy value, and to rupture said link for rapid opening of said plates to provide a substantially step function exit of the beam.

2. A shutter mechanism as in claim 1 with an orifice for escape of air behind said pistons for dash pot operation of said shutters.

* * * * *